US006378259B1

(12) United States Patent
Carlson

(10) Patent No.: US 6,378,259 B1
(45) Date of Patent: Apr. 30, 2002

(54) ROOFING FELT WITH ADHESIVE ON FRONT AND REAR FACES

(76) Inventor: Douglas Carlson, P.O. Box 2292, Shelby, NC (US) 28151

( * ) Notice: Subject to any disclaimer, the term of this patent is extended or adjusted under 35 U.S.C. 154(b) by 0 days.

(21) Appl. No.: 09/451,529

(22) Filed: Dec. 1, 1999

(51) Int. Cl.[7] ..... E04B 5/00

(52) U.S. Cl. ..... 52/408; 52/411; 156/71; 156/291; 428/40.3; 428/343

(58) Field of Search ..... 52/DIG. 16, 408, 52/411; 156/71, 291; 428/40.3, 343, 351, 352, 354, 42.3

(56) References Cited

U.S. PATENT DOCUMENTS 2,096,784 A * 10/1937 Candler ..... 52/DIG. 16 X
3,049,836 A * 8/1962 Weissman ..... 52/DIG. 16 X
3,080,683 A * 3/1963 Sallie ..... 52/DIG. 16 X
3,903,340 A * 9/1975 Shepherd ..... 52/DIG. 16 X
4,380,563 A 4/1983 Ayotte
4,757,652 A 7/1988 Kalkanoglu
5,593,748 A 1/1997 Hubbard
5,593,771 A 1/1997 Lawless et al.
5,687,517 A 11/1997 Wiercinski et al.
5,737,897 A 4/1998 Naipawer, III
5,772,816 A 6/1998 Hubbard
5,924,252 A * 7/1999 Deike ..... 52/DIG. 16 X

* cited by examiner

*Primary Examiner*—Carl D. Friedman
*Assistant Examiner*—Dennis L. Dorsey
(74) *Attorney, Agent, or Firm*—Moore & Hansen

(57) ABSTRACT

A protective barrier laminate underlayment used to cover the surface of a structure, such as a house, just beneath the outermost, weather bearing layer. The underlayment has an adhesive layer on its lower side for securing the underlayment to the roof and a pattern of adhesive areas on its upper side for allowing a construction worker to walk on the underlayment without slipping. The upper adhesive layer also prevents tools and other objects such as stacks of shingles from sliding off of the roof during construction.

12 Claims, 1 Drawing Sheet

18
20
12
23
16
14
24
20
16
10
22
12

10
22
24
22
24
14
3
20
16
3
20
16
20
12
10
20
24
24
24
14
20
22
20
22
20
22
16
20
12

ROOFING FELT WITH ADHESIVE ON FRONT AND REAR FACES

BACKGROUND OF THE INVENTION

This invention relates generally to a protective barrier layer used to cover the surface of a structure, such as a house, just beneath the outermost, weather bearing layer. More specifically, this invention relates to an underlayment having the advantages possessed by roofing felt and other underlayments, and additionally having an adhesive layer on its lower surface for securing the felt to the roof and farther having a pattern of adhesive areas on its upper surface to make it less slippery for a construction worker to walk on the felt during construction. These upper adhesive areas also help prevent tools and other objects such as stacks of shingles from sliding off of the roof during construction.

Roofing felt is a well known underlayment used in the construction of a roof. The purpose of roofing felt is to provide a moisture and wind barrier to the roof, thereby supplementing the protection provided by the outermost weather bearing shingles. The felt is applied to a completed roof deck and then covered by roofing materials such as asphalt shingles, slate tiles, Spanish tiles, or the like.

Installation of traditional roofing felt can be a dangerous endeavor. Most available roofing felt can be somewhat slippery and can easily slide relative to the roof deck until it is tacked to the deck. Once attached to the roof deck, a construction worker necessarily must walk or crawl on the felt in order to install the shingles.

One problem arises on an angled roof when the coefficient of friction between the roof deck and the unattached felt is relatively low. A worker walking on the felt can cause the felt to slide down the roof deck, thereby creating a risk of serious injury or death to the worker. Typically, applying a layer of underlayment requires more than one roofer. A first roofer spreads the felt over the roof deck, arranging the felt for adequate coverage. A second roofer follows, temporarily securing the felt to the roof deck using staples or roofing nails. In order to conserve nails and reduce the number of punctures in the felt, only a few nails are used during this step. The felt will be fully secured once the shingles are arranged over the felt and nailed into place. Doing so, however, requires that at least one worker walk over the temporarily secured felt in order to attach the shingles. This forces the nails holding the felt in place to support some of the worker's weight which can result in tearing the felt or stretching the holes in the felt surrounding the nails, thereby breaching the felt's watertight integrity. This also can pose a serious safety hazard to the worker.

Another problem with walking on the roofing felt is presented when the coefficient of friction between the upper surface of the felt and the soles of the worker's boots, or objects resting on the felt, is too low. This problem results in a potential slipping hazard to the worker. Additionally, objects placed on the roof may slide and fall off the roof, damaging the objects, and exposing any people below to a risk of injury.

It would be desirable to develop an underlayment for use as roofing felt or housewrap with an adhesive layer on its bottom surface for providing a predetermined amount of adherence to a surface and which has a pattern of adhesive areas on its upper surface for providing a tacky, safe surface onto which objects can be placed and people can walk with a reduced chance of slipping, even when used on a sloped roof.

SUMMARY OF THE INVENTION

Advantageously, the roofing felt of the present invention generally provides a water and wind barrier which adheres to a roof deck sufficiently such that the barrier does not slide when weight is placed thereon.

It is another advantage of the invention to provide an underlayment that has a predetermined pattern of adhesive areas on its upper surface which provide adequate traction for a person walking on the laminate while finishing the construction of a roof.

It is also a characteristic of the invention to provide a weather barrier with a greater degree of adhesion between the barrier and the roof deck than that between the upper surface of the barrier and objects placed thereon such that walking on the barrier or removing objects from the upper surface of the barrier does not result in relocation of the barrier on the roof deck.

It is yet another advantage of the invention to provide an underlayment with an adhesive on its bottom surface which allows the laminate to adhere to a roof deck yet further allows the laminate to be removed and reapplied if necessary.

It is still yet another advantage of the present invention to provide an underlayment with an adhesive on its bottom surface which adheres to a roof deck sufficiently so that while being applied, the laminate is less susceptible to being blown by the wind or sliding from its desired location and thereby facilitates easy installation by a single worker.

It is also a characteristic of the invention to provide an underlayment with sufficient adhesive areas on its upper surface so that the underlayment's ability to provide traction to workers and objects on the upper surface is not jeopardized by the presence of wind blown dirt, leaves and other debris, while allowing leaves, branches and other debris to be easily removed from the adhesive areas.

The lower adhesive layer preferably covers the entire lower surface of the underlayment. The adhesive properties of the lower adhesive layer are such that once the underlayment is applied to the roof deck, the underlayment can be removed and repositioned without ripping the material or leaving residue on the roof deck. The underlayment may also be folded into rolls for storage and shipping, and subsequently unrolled onto a roof during application with relative ease, much like a roll of tape. It would be undesirable if damage resulted to the underlayment due to the effort required to overcome its own adhesive properties while attempting to unroll it onto a roof deck.

The lower adhesive layer provides several advantages. For example, it allows a single person to unroll a length of the underlayment onto a roof deck as it is not susceptible to sliding down the deck, even when walked upon, or being blown by the wind. This lower adhesive layer also prevents the roll itself from slipping down an inclined roof and from unraveling and telescoping downwardly along the roll's rotational axis. Furthermore, inasmuch as the lower adhesive layer keeps the underlayment in place until the shingles are attached, the need to nail the underlayment in place is obviated. This reduces the number of puncture holes in the underlayment, thereby significantly improving its watertight integrity.

The upper adhesive layer is preferably formed by the collective adhesive effects of either a plurality of spaced apart adhesive areas and the non-adhesive areas therebetween, or a lighter adhesive coat. The layer generally spans the entirety of the upper surface. Preferably, the magnitude of the adhesive properties of the upper layer is less than that of the lower layer. A weaker upper adhesive layer facilitates improved traction to both objects and people while avoiding the problem of separating the underlayment from the roof deck when a worker treads on the underlayment or lifts objects therefrom. To this end, it is more preferable to provide a plurality of spaced apart adhesive areas with non-adhesive areas therebetween. These non-adhesive spaces serve not only to reduce the level of adhesion of the upper adhesive layer so that it is lower than that of the lower adhesive layer, but also reduce the amount of debris, such as leaves and construction residue, caught by the adhesive of the upper adhesive layer.

These and other objectives and advantages of the invention will appear more fully from the following description, made in conjunction with the accompanying drawings wherein like reference characters refer to the same or similar parts throughout the several views. And although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

DETAILED DESCRIPTION

Figures 1, 2, 3:
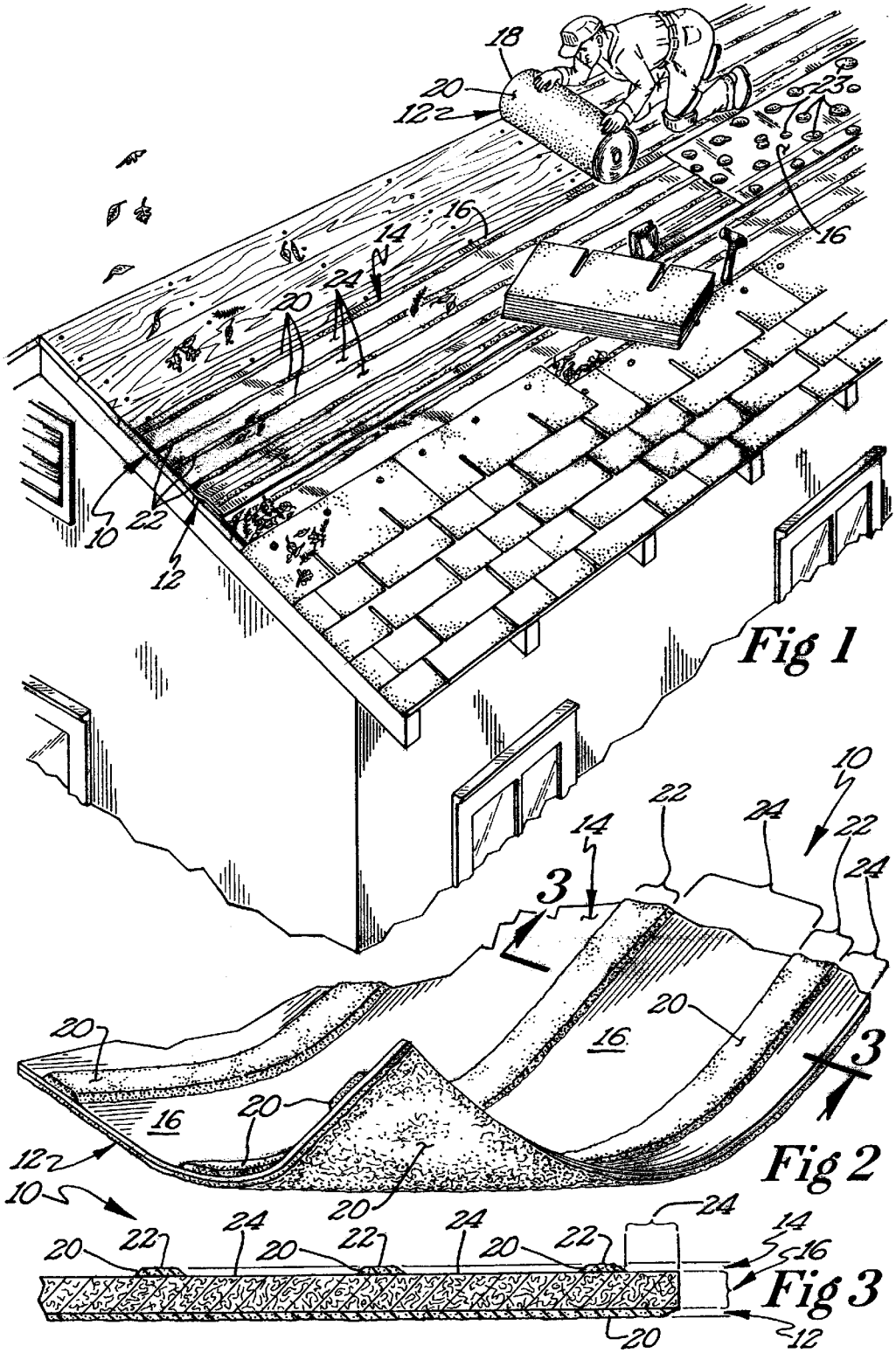
FIG. 1 is a perspective elevational view of a roof under construction depicting an envisioned use of the present invention in the construction of the roof.
FIG. 2 is a perspective view of the present invention.
FIG. 3 is an elevational view of a cross-section of the present invention, taken generally along line 3—3 of FIG. 2.

Referring now to FIG. 1, there is shown a construction worker engaged in the construction of a roof. The worker is unrolling a roll 18 of underlayment 10 over a roof deck to create a weather proof barrier over the roof. The underlayment 10 remains in place on the roof deck, despite the presence of wind, due to lower adhesive layer 12. The worker, tools, and uninstalled shingles depicted in the drawing resist slipping because of the traction provided by upper adhesive layer 14.

FIGS. 2 and 3 provide enlarged views of the details of underlayment 10. Lower adhesive layer 12 and upper adhesive layer 14 are attached to continuous, sheet-like base layer 16. Base 16 could be any known underlayment or roofing felt suitable to receive adhesive layers 12 and 14. Preferably, base 16 is flexible so that underlayment 10 may formed into a roll 18 (shown in FIG. 1) for efficient storage and ease of installation.

Lower adhesive layer 12 comprises a low-level adhesive 20 sprayed or otherwise applied onto a base layer 16 for providing a first degree of adhesion between the adhesive 20 and the base layer 16, and a second degree of adhesion between the lower adhesive layer 12 and the roof deck. It is preferable that the adhesive adhere to base 16 more strongly than it does to other surfaces such as a roof deck. In other words, it is preferable that the first degree of adhesion is greater than the second degree of adhesion. This quality allows the underlayment to be positioned and repositioned without leaving adhesive residue on the roof deck, and without tearing or delaminating the underlayment 10. It is further desired that layer 12 retain its adhesive properties despite being repositioned and stored in rolls.

Upper adhesive layer 14 also comprises a low-level adhesive 20 sprayed or otherwise applied onto base 16 for providing a third degree of adhesion between the adhesive 20 and the base 16, and a fourth degree of adhesion between the upper adhesive layer 14 and objects placed thereon. Preferably, the fourth degree of adhesion is less than the second degree of adhesion. It is also preferable that the third degree of adhesion is greater than the fourth degree of adhesion. It is preferable that upper adhesive layer 14 have a lower level of adhesion than lower level 12 so that a worker walking on underlayment 10 will not cause underlayment 10 to separate from the roof deck. To facilitate this lower level of adhesion, upper adhesive layer 14 preferably has adhesive strips 22 and spaces 24 between strips 22 where no adhesive is applied. Such a configuration also limits the areas on which leaves and other debris may get stuck.

Strips 22 are preferably from 0.25 inches to 1.5 inches wide, more preferably on the order of 0.5 inches wide. Spaces 24 are preferably from 1 inch to 6 inches wide, more preferably 2 to 4 inches wide, and even more preferably on the order of 3 inches wide. This spacing configuration ensures adequate traction for people and objects, provides a lower level of adhesion for the upper adhesive layer 14 than that of the lower adhesive layer 12, and allows for relatively easy debris removal.

In an alternative embodiment (not shown in the Figures), the upper adhesive layer is formed of a continuous layer of the adhesive, however, the layer is either markedly thinner than that of the lower adhesive layer, or formed from a different type of adhesive or even a rubber-like material. This configuration would also provide a lower level of adhesion on the upper layer than that of the lower layer.

Note that the upper adhesive layer may also be formed as randomly configured areas or spots 23 that are randomly applied to the upper surface of the base 16, as opposed to uniformly configured and positioned adhesive strips 22. It is also envisioned, but not shown in the Figures, that the upper adhesive layer be formed of alternative adhesive patterns such as cross-hatching and grids.

In operation, as a worker unrolls a roll 18 of underlayment 10 onto a roof deck, adhesive 20 of lower adhesive layer 12 adheres to the roof deck, thereby preventing underlayment 10 from slipping. The worker traverses the roof by walking or crawling on the upper adhesive layer 14 of that portion of underlayment 10 which has been unrolled. The worker's traction on the underlayment is improved by adhesive 20 of upper adhesive layer 14. Adhesive 20 remains affixed to base layer 16, however, because the degree of adherence between base layer 16 and adhesive 20 of upper adhesive layer 14 is greater than the degree of adherence between the adhesive 20 of upper adhesive layer 14 and the worker's soles or knees.

Similarly, the degree of adherence between adhesive 20 of lower adhesive layer 12 and the roof deck is lower than the degree of adherence between base layer 16 and adhesive 20 of lower adhesive layer 12. Therefore, after unrolling underlayment 10 onto the roof deck, underlayment 10 may be repositioned without damaging lower adhesive layer 12.

Once underlayment 10 has been placed in a desired position, shingles or other similar roofing material is installed over underlayment 10. Nailing or stapling underlayment 10 in place prior to this step has been obviated by the adhesive properties of lower adhesive layer 12. Again, the varying degrees of adherence, as described above, allow a worker to transverse over underlayment 10, and place tools thereon, without causing damage to underlayment 10. As the shingles are nailed into place, underlayment 10 is permanently secured to the roof deck.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claim.

What is claimed is:

1. An underlayment for use in providing a barrier between the outer surface of a structure and a layer of exterior finish material, with the underlayment positioned adjacent the outer surface of the structure and the exterior finish material positioned thereover, the underlayment comprising:

a flexible base layer having upper and lower surfaces;

an upper adhesive layer on said upper surface of said base layer; and, a lower adhesive layer on said lower surface of said base layer;

wherein said lower adhesive layer comprises a single contiguous surface area and said upper adhesive layer comprises a plurality of spaced apart adhesive areas.

2. The underlayment of claim 1, wherein the spaced apart adhesive areas further comprises a plurality of adhesive strips extending across said upper surface of said base layer.

3. The underlayment of claim 1, wherein the spaced apart adhesive areas further comprises a plurality of random sizes and randomly spaced areas.

4. The underlayment of claim 2 wherein the adhesive strips are between 0.25 and 1 inches wide and spaced on the order of 1 inch to 6 inches apart.

5. The underlayment of claim 4 wherein the adhesive strips are between 1/7 and 1/5 as wide as the spaces in between the strips.

6. The underlayment of claim 1, wherein said lower adhesive layer is substantially coextensive with said lower surface of said base layer.

7. The underlayment of claim 1, wherein the surface area of the lower adhesive layer is greater than the surface area of the upper adhesive layer.

8. The underlayment of claim 1, wherein the spaced apart adhesive areas further comprises a plurality of randomly sized areas.

9. The underlayment of claim 1, wherein the spaced apart adhesive areas further comprises a plurality of randomly spaced areas.

10. The underlayment of claim 2, wherein said adhesive strips are substantially parallel.

11. An underlayment for use in providing a barrier between the outer surface of a structure and a layer of exterior finish material, with the underlayment positioned adjacent the outer surface of the structure and the exterior finish material positioned thereover, the underlayment comprising:

a flexible base layer having upper and lower surfaces;

an upper adhesive layer on said upper surface of said base layer; and, a lower adhesive layer on said lower surface of said base layer;

wherein said lower adhesive layer a single comprises a single contiguous surface area and said upper adhesive layer comprises a plurality of spaced apart adhesive areas, and wherein the surface area of the lower adhesive layer is greater than the surface area of the upper adhesive layer.

12. An improved underlayment of the type comprising a flexible, moisture resistant material having upper and lower surfaces, the underlayment used to provide a protective barrier between an outer surface of a structure and roof coverings, the improvement comprising a:

a lower adhesive layer on the lower surface of the underlayment, the lower adhesive layer comprising a single contiguous surface area; and, an upper adhesive layer on the upper surface of the underlayment, the upper adhesive surface comprising a plurality of spaced apart adhesive areas;

wherein the surface area of the lower adhesive layer is greater than the surface area of the upper adhesive area.

* * * * *